US008297957B2

(12) United States Patent
Park et al.

(10) Patent No.: US 8,297,957 B2
(45) Date of Patent: Oct. 30, 2012

(54) COMPRESSOR

(75) Inventors: Kyoung-Jun Park, Gyeongsangnam-Do (KR); Ji-Young Bae, Busan (KR); Jin-Kook Kim, Gyeongsangnam-Do (KR); Bum-Joon Kim, Gyeongsangnam-Do (KR); Hyuk Nam, Gyeongsangnam-Do (KR); Jong-Mok Lee, Gyeongsangnam-Do (KR); Jong-Hyuk Kim, Gyeongsangnam-Do (KR); Kyeong-Ho Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 840 days.

(21) Appl. No.: 12/227,135

(22) PCT Filed: Dec. 29, 2006

(86) PCT No.: PCT/KR2006/005904

§ 371 (c)(1),
(2), (4) Date: Nov. 7, 2008

(87) PCT Pub. No.: WO2007/129804

PCT Pub. Date: Nov. 15, 2007

(65) Prior Publication Data

US 2009/0175746 A1 Jul. 9, 2009

(30) Foreign Application Priority Data

May 10, 2006 (KR) ..... 10-2006-0042129

(51) Int. Cl.

| | |
|---|---|
| ***F04B 39/00*** | (2006.01) |
| ***F04B 53/10*** | (2006.01) |
| ***F16K 15/03*** | (2006.01) |
| ***F16K 21/04*** | (2006.01) |

(52) U.S. Cl. ..... 417/565; 137/512

(58) Field of Classification Search ..... 417/559, 417/562, 565, 572; 137/512, 512.15, 855–858
See application file for complete search history.

(56) References Cited

U.S. PATENT DOCUMENTS

| | | | | |
|---|---|---|---|---|
| 3,509,907 | A * | 5/1970 | Gannaway | 137/512 |
| 4,325,680 | A * | 4/1982 | Bar | 417/569 |
| 5,558,508 | A * | 9/1996 | Sasano et al. | 417/569 |
| 6,318,980 | B1 * | 11/2001 | Kurihara et al. | 417/571 |

(Continued)

FOREIGN PATENT DOCUMENTS

| | | |
|---|---|---|
| CN | 1382910 | 12/2002 |

(Continued)

*Primary Examiner* — Devon Kramer
*Assistant Examiner* — Bryan Lettman
(74) *Attorney, Agent, or Firm* — McKenna Long & Aldridge LLP

(57) ABSTRACT

A compressor having a casing to which a gas suction pipe is connected; a driving motor provided in the casing; a cylinder; a valve supporting plate (210) covering the cylinder (300), the valve supporting plate (210) having a suction hole (212) for sucking gas into the cylinder (300) and two discharge holes (211) for discharging gas compressed in the cylinder (300); a piston (100) having two protrusions (101) at a pressure surface in correspondence to the two discharge holes (211) of the valve supporting plate (210), the protrusions (101) having different sized cross-sections, the piston being linearly reciprocal in the cylinder (300) by receiving a driving force of the driving motor; a suction valve coupled to the valve supporting plate (210) to open and close the suction hole (212); a discharge valve coupled to the valve supporting plate to open and close the two discharge holes (211).

18 Claims, 7 Drawing Sheets

U.S. PATENT DOCUMENTS 6,540,492 B2 * 4/2003 Kaido et al. ..... 417/562

FOREIGN PATENT DOCUMENTS

DE 4218631 12/1992
EP 1249605 10/2002
JP 03-175174 7/1991
WO WO 00/71896 11/2000

* cited by examiner

COMPRESSOR

This application is a U.S. national stage application of International Application No. PCT/KR2006/005904, filed on Dec. 29, 2006, and claims the benefit of Korean Application No. 10-2006-0042129, filed on May 10, 2006, which is incorporated by reference for all purposes as if fully set forth herein.

TECHNICAL FIELD

The present invention relates to a compressor, and more particularly, to a compressor capable of reducing a pressure loss when gas compressed in a cylinder is discharged outside the cylinder, minimizing a dead volume, and enhancing a suction efficiency of gas sucked into the cylinder.

BACKGROUND ART

Generally, a compressor is a device for compressing gas by converting electric energy into kinetic energy. The compressor may be classified as a rotary compressor, a reciprocating compressor, a scroll compressor, etc. according to a compression mechanism used for compressing gas.

FIG. 1 shows a reciprocating compressor in accordance with the conventional art. Referring to FIG. 1, when a driving motor 20 inside a casing 10 is operated, a rotation force of the driving motor 20 is transmitted to a piston 40 through a crankshaft 30 coupled to the driving motor 20. As the rotation force of the driving motor 20 is transmitted to the piston 40 through the crankshaft 30 and a connecting rod 90, the piston 40 is linearly reciprocated in a cylinder 50 integrally formed with a cylinder block B. As the result, gas sucked into the casing 10 through a gas suction pipe 1 is sucked and compressed through a valve assembly VA and a suction muffler 60 coupled to the cylinder 50, and then is discharged through the valve assembly VA and a discharge muffler 70. The refrigerant that has been discharged through the valve assembly VA and the discharge muffler 70 is discharged outside the casing 10 through a loop pipe 80 and a gas discharge pipe 2.

Reference numeral SL denotes a silencer.

As shown in FIG. 2, the valve assembly VA for sucking gas into the cylinder 50 and discharging gas compressed in the cylinder 50 comprises: a valve supporting plate 110 having a rectangular shape and a certain thickness; a suction valve 120 and a discharge valve 130 positioned at both side surfaces of the valve supporting plate 110; and a retainer 140 mounted at the valve supporting plate 110 for limiting a motion of the discharge valve 130.

The valve supporting plate 110 comprises a rectangular plate 111 having a certain area and thickness, a suction hole 112 and a discharge hole 113 formed in the plate 111, and a plurality of coupling holes 114 formed at each corner of the plate 111. The number of the suction hole 112 and the discharge hole 113 is one each, respectively, and the suction hole 112 is formed below the discharge hole 113.

The suction valve 120 comprises a thin plate 121 having a certain area, a slit 122 formed in the thin plate 121 as a curved line, a valve portion 123 having a cantilever shape by the linear slit 122, a discharge hole 124 formed in the thin plate 121, and a plurality of coupling holes 125 formed at each corner of the thin plate 121. A free end of the valve portion 123 is positioned at a lower portion, and a connection portion between the valve portion 123 and the thin plate 121 is positioned at an upper portion. The discharge hole 124 is connected to the slit 122.

The discharge valve 130 is formed as a thin plate having a certain shape, and is fixedly coupled to one side surface of the valve supporting plate 110 so as to open and close the discharge hole 113 of the valve supporting plate. The retainer 140 for limiting a motion of the discharge valve 113 is coupled onto the discharge valve 113.

The valve assembly VA is coupled to the cylinder 50 by coupling bolts (not shown) under a state that the suction valve 120 comes in contact with the cylinder 50. Herein, the valve portion 123 of the suction valve 120 opens and closes the suction hole 112 of the valve supporting plate 110, and the discharge valve 130 opens and closes the discharge hole 113 of the valve supporting plate 110.

An operation of the valve assembly of the compressor will be explained as follows.

When the piston 40 is moved to a lower dead point, the valve portion 123 of the suction valve 120 is curved by a pressure difference between inside and outside of the cylinder 50 to open the suction hole 112 of the valve supporting plate 110. At the same time, gas introduced through the suction muffler 60 is sucked into the cylinder 50 through the suction hole 112.

When the piston 40 is moved to an upper dead point from the lower dead point, the valve portion 123 of the suction valve 120 closes the suction hole 112 of the valve supporting plate 110 and the sucked gas is gradually compressed. When the compressed gas has a pressure more than a set pressure, the discharge valve 130 is curved to thereby open the discharge hole 113. Accordingly, the compressed gas is discharged through the discharge hole 124 of the suction valve and the discharge hole 113 of the valve supporting plate.

DISCLOSURE OF INVENTION

Technical Problem

However, the conventional compressor has the following problems. Since one path for discharging gas compressed in the cylinder 50 outside the cylinder 50 is formed, compressed gas is concentrated into one part at the time of a gas discharge. Accordingly, a discharge flow resistance is increased and thus a large pressure loss is generated. As shown in FIG. 3, a dead volume (DA) is generated by the discharge hole 124 of the suction valve and the discharge hole 113 of the valve supporting plate 110 at the time of discharging compressed gas. Accordingly, a suction loss is generated at the time of a gas suction.

Furthermore, since one path for sucking gas into the cylinder 50 is formed, compressed gas is concentrated into one part at the time of a gas suction into the cylinder 50 through the path. Accordingly, a suction flow resistance is increased and thus a gas suction efficiency is lowered, thereby lowering a compression efficiency of the compressor.

Technical Solution

Therefore, an object of the present invention is to provide a compressor capable of reducing a pressure loss when gas compressed in a cylinder is discharged outside the cylinder, minimizing a dead volume, and enhancing a suction efficiency of gas sucked into the cylinder.

To achieve these and other advantages and in accordance with the purpose of the present invention, as embodied and broadly described herein, there is provided a compressor including a casing to which a gas suction pipe is connected; a driving motor provided in the casing; a cylinder; a valve supporting plate covering the cylinder and having a suction hole for sucking gas into the cylinder and two discharge holes for discharging gas compressed in the cylinder; a piston having two protrusions at a pressure surface in correspondence to the two discharge holes of the valve supporting plate, the two protrusions having different sized cross-sections, the piston being linearly reciprocal in the cylinder by receiving a driving force of the driving motor; a suction valve coupled to the valve supporting plate to open and close the suction hole; and a discharge valve assembly coupled to the valve supporting plate to open and close the two discharge holes.

Another aspect of the present invention is directed to a cylinder assembly including the cylinder, piston, suction valve, and discharge valve as set forth above.

Yet another aspect of the present invention is directed to a valve assembly including the suction valve and discharge valve as set forth above.

The foregoing and other objects, features, aspects and advantages of the present invention will become more apparent from the following detailed description of the present invention when taken in conjunction with the accompanying drawings.

However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

MODE FOR THE INVENTION

Reference will now be made in detail to the preferred embodiments of the present invention, examples of which are illustrated in the accompanying drawings. Hereinafter, a compressor according to the present invention will be explained in more detail with reference to the attached drawings.

Figure 1:
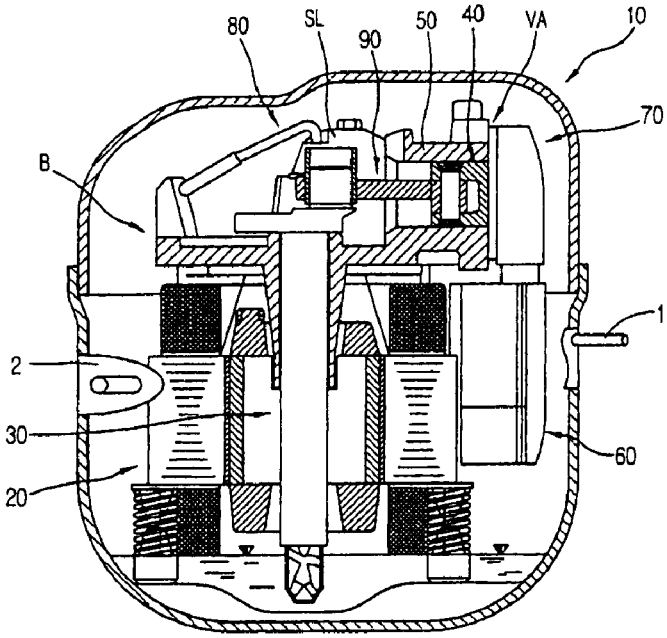
FIG. 1 RELATED ART
FIG. 1 is a sectional view showing a reciprocating compressor in accordance with the conventional art.
Figure 2:
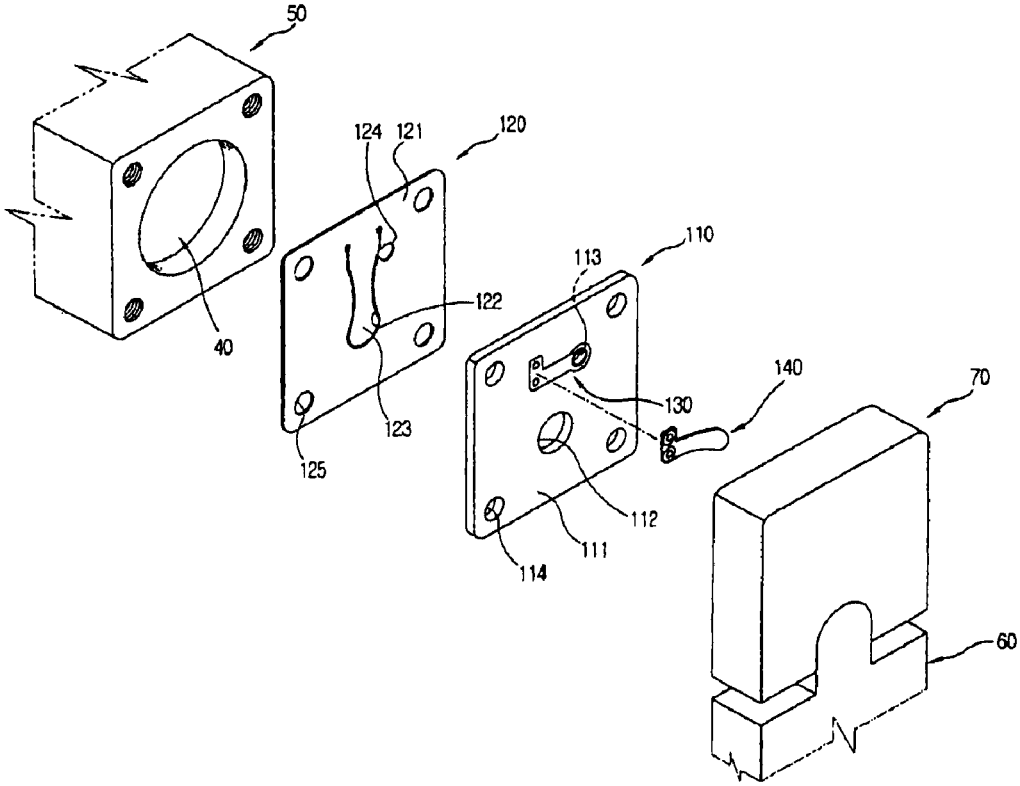
FIG. 2 RELATED ART
FIG. 2 is a disassembled perspective view showing a valve assembly of the reciprocating compressor in accordance with the conventional art.
Figure 3:
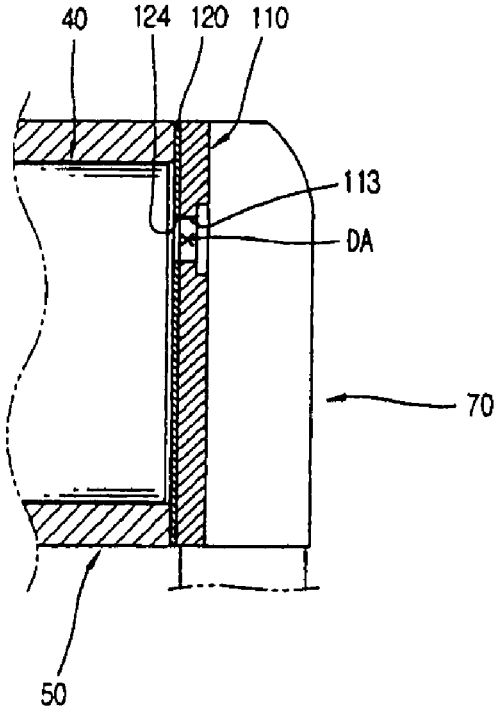
FIG. 3 RELATED ART
FIG. 3 is a sectional view showing a dead volume of the valve assembly of the reciprocating compressor in accordance with the conventional art.
Figure 4:
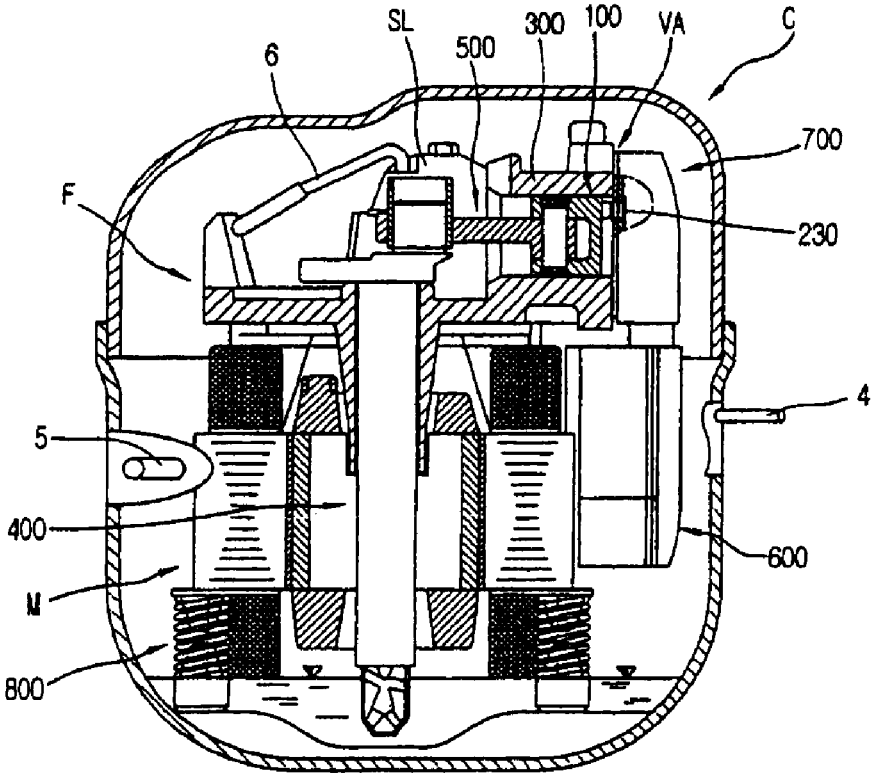
FIG. 4 is a sectional view showing a compressor according to the present invention.

FIG. 4 is a sectional view showing a compressor according to the present invention.

As shown, the compressor comprises a casing C; a frame F positioned in the casing C and having a cylinder 300 at one side thereof. A driving motor M is positioned below the frame F and a crankshaft 400 is inserted into the frame F and coupled to the driving motor M. A connecting rod 500 is movably inserted into the cylinder 300 and connects a piston 100 having two protrusions 101 at a pressure surface CS to the crankshaft 400 to convert a rotational motion of the crankshaft 400 into a linear reciprocation motion of the piston 100. A valve assembly 200 has a valve supporting plate (not shown) having two discharge holes and mounted at one side of the cylinder 300. A suction muffler 600 and a discharge muffler 700 are coupled to the valve assembly 200, and an elastic support unit 800 is mounted between a lower portion of the driving motor M and an inner wall of the casing C to elastically support the inner components including the driving motor M.

Reference numeral 4 denotes a gas suction pipe, 5 denotes a gas discharge pipe, 6 denotes a loop pipe, and SL denotes a silencer.

Figure 5:
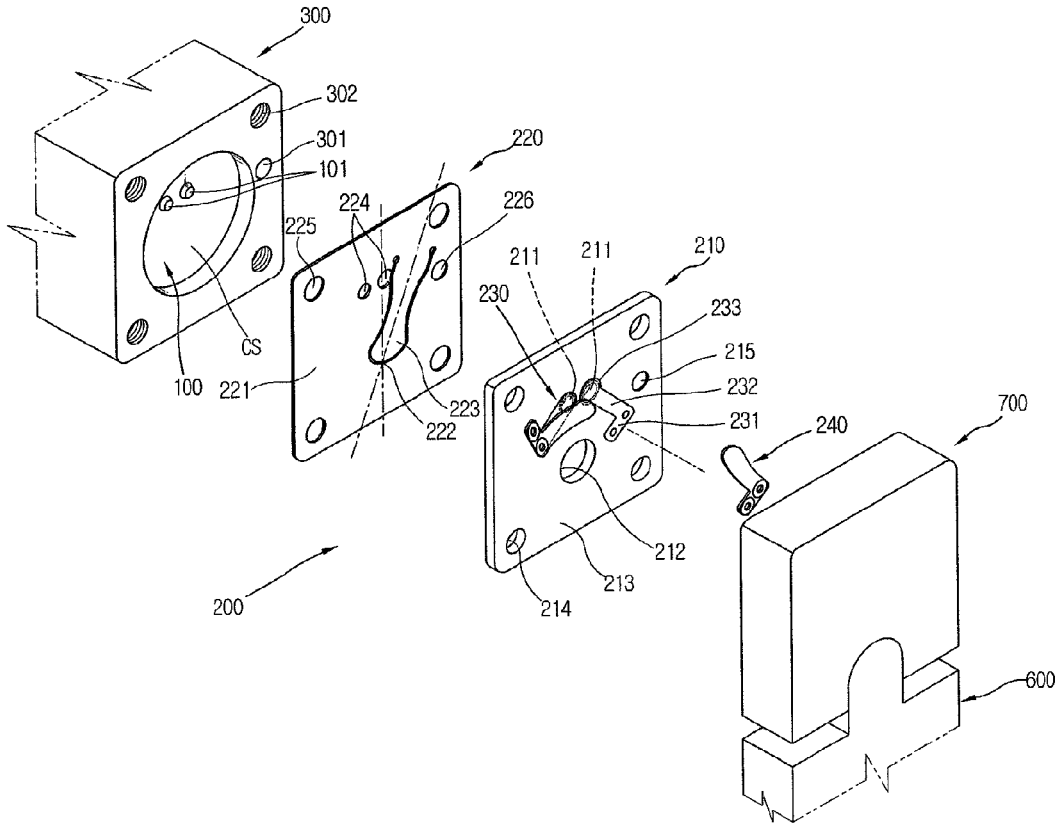
FIGS. 5 and 6 are respectively a disassembled perspective view and a frontal view showing a valve assembly of the compressor according to a first embodiment of the present invention.
Figure 6:
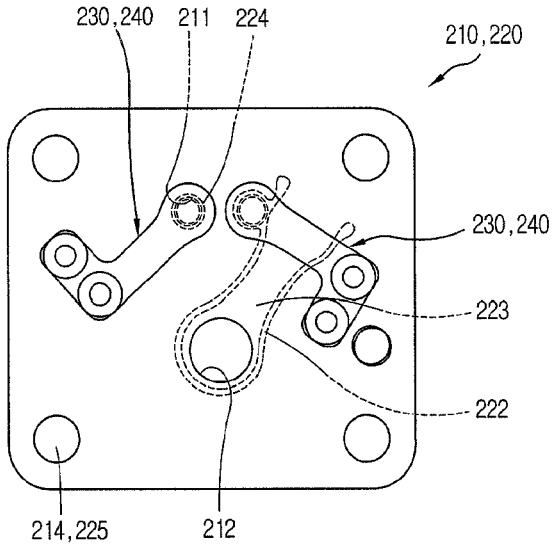

As shown in FIGS. 5 and 6, the valve assembly 200 includes a valve supporting plate 210 covering the cylinder 300. The valve supporting plate 210 has a suction hole 212 for sucking gas into the cylinder 300 and two discharge holes 211 for discharging gas compressed in the cylinder 300. The valve assembly 200 also includes a suction valve 220 having two protrusions corresponding to the two discharge holes 211 of the valve supporting plate 210 and coupled to the valve supporting plate 210 to open and close the suction hole 212. Discharge valves 230 are respectively coupled to the valve supporting plate 210 to open and close the two discharge holes 211. Retainers 240 are mounted at the valve supporting plate 210 to limit motion of each of the discharge valves 230.

The valve supporting plate 210 includes a rectangular plate 213 having a certain thickness, discharge holes 211 formed in the plate 213 with a certain gap therebetween, one suction hole 212 penetratingly formed at the plate 213 so as to be positioned below the discharge hole 211, and a plurality of coupling holes 214 formed at each corner of the plate 213.

The two discharge holes 211 may be formed to have the same size or different sizes from each other. When the two discharge holes 211 are formed to have different sizes from each other, a ratio (d2/d1) between an inner diameter (d1) of a relatively larger discharge hole of the two discharge holes and an inner diameter (d2) of a relatively smaller discharge hole is preferably in a range of 1.1~1.3. Also, when the two discharge holes 211 are formed to have the same size, each of the discharge holes 211 is preferably equal to half the area of the conventional discharge hole 113.

A peripheral portion of the discharge holes 211 is concaved with a certain shape and depth, so that an edge of the discharge hole 211 is protruded. Preferably, the valve supporting plate 210 is formed of a sheet metal.

The two protrusions 101 formed at the pressure surface CS of the piston 100 correspond to the number and the size of the discharge holes 211 of the valve supporting plate 210.

In the exemplary embodiment shown, there is one suction hole 212 that is formed below the discharge holes 211.

Figure 7:
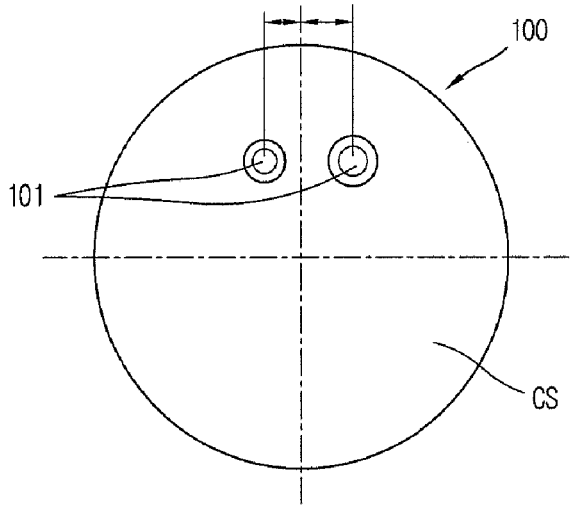
FIG. 7 is a frontal view showing a piston of the compressor according to the present invention.

As shown in FIG. 7, the two protrusions 101 formed at the pressure surface CS of the piston 100 are formed at positions having different distances from a central line of the pressure surface CS.

Figure 8:
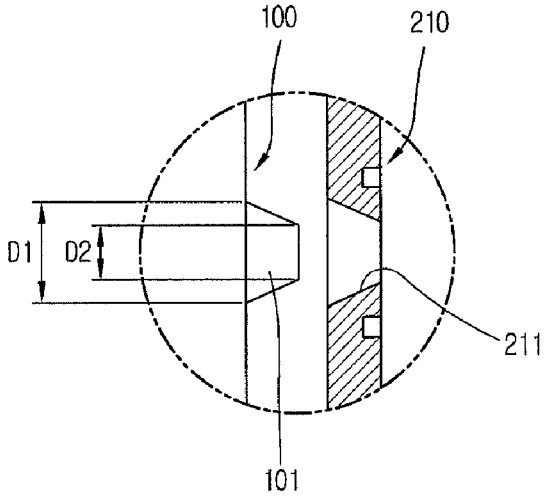
FIG. 8 is a side sectional view showing the piston and a valve supporting plate of the compressor according to the present invention.

As shown in FIG. 8, the protrusion 101 of the piston 100 is formed to have a truncated conical shape, and an inner circumferential surface of the discharge hole 211 of the valve supporting plate 210 is formed to have a conical shape. Preferably, a ratio (D2/D1) between a maximum outer diameter D1 positioned at the pressure surface and a minimum outer diameter D2 of an end surface of the protrusion 101 is in a range of 1.5 to 2.5.

The protrusion 101 of the piston 100 and the discharge hole 211 of the valve supporting plate 210 can have the same inclination angle or different inclination angles from each other.

Figure 9:
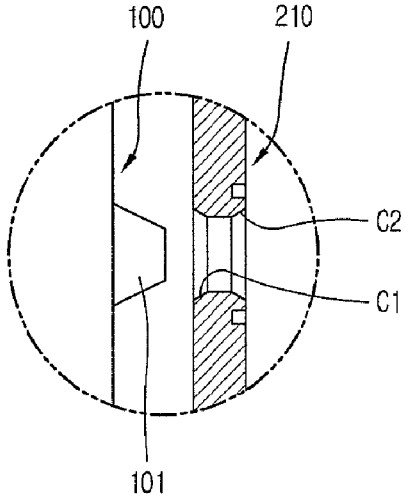
FIG. 9 is a side sectional view showing a piston and a valve supporting plate of the compressor according to another embodiment of the present invention.

As shown in FIG. 9, chamfers C1 and C2 for decreasing a flow resistance are respectively formed at both edges of an inner circumferential surface of the discharge hole 211 of the valve supporting plate.

The suction valve 220, as shown in FIG. 5, comprises a thin plate 221 having the same size as the valve supporting plate 210, a slit 222 formed in the thin plate 221 as a curved line, a valve portion 223 having a cantilever shape defined by the linear slit 222, two discharge holes 224 formed in the thin plate 221, and a plurality of coupling holes 225 formed at each corner of the thin plate 221.

The valve portion 223 is composed of a connection portion connected to the thin plate 221, and an open/close portion extending from the connection portion so as to have a certain area. The valve portion 223 is formed to be inclined by a certain angle from a vertical centerline of the thin plate 221. The two discharge holes 224 are symmetrical to each other on the basis of the vertical centerline of the thin plate 221, and are positioned above the open/close portion of the valve portion 223. One discharge hole 224 is connected to the slit 222.

The discharge valve 230 is formed as a thin plate having a certain shape. The discharge valve 230 comprises a fixing portion 231 having a certain area, a connecting portion 232 extending from the fixing portion 231, and an open/close portion 233 extending from the connecting portion 232 with a certain area. The discharge valve 230 is fixedly coupled to the valve supporting plate 210 accordingly as the fixing portion 231 is riveted to the valve supporting plate 210. Herein, the open/close portion 233 of the discharge valve 230 closes the discharge hole 211 of the valve supporting plate 210.

The retainer 240 is formed to have the same shape as the discharge valve 230 and to have a certain thickness. The retainer 240 is fixedly coupled to the valve supporting plate 210 together with the discharge valve 230.

Connection holes 215 and 226 are formed so as to be connected to the valve supporting plate 210 and the suction valve 220, respectively. The connection holes 215 and 226 are connected to a connection hole 301 formed at the cylinder 300. The connection hole 301 is connected to a silencer SL coupled to the cylinder 300 for reducing noise.

Figure 10:
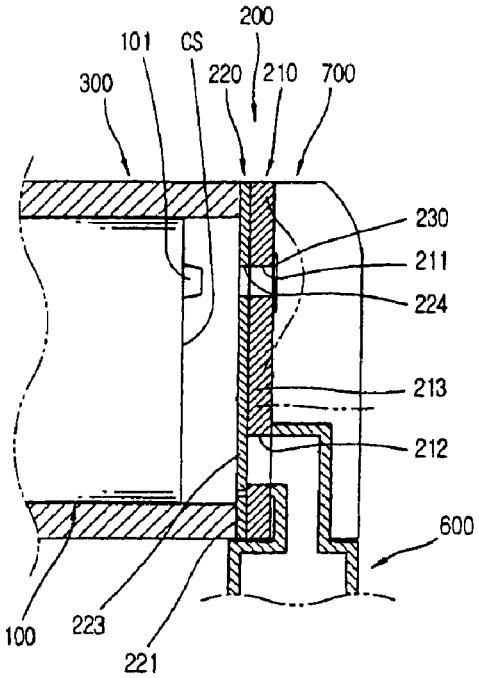
FIG. 10 is a side sectional view showing a coupled state of a valve assembly of the compressor according to the present invention.

An assembly process of the components including the valve assembly 200 of the compressor will be explained. As shown in FIG. 10, the discharge valves 230 are fixedly coupled to one side surface of the valve supporting plate 210 by riveting (not shown for clarity), and the suction valve 220 is positioned at another side surface of the valve supporting plate 210. Then, the valve assembly is positioned at the cylinder 300 so that the suction valve 220 can come in contact with the cylinder 300. Then, the discharge muffler 700 and the suction muffler 600 are fixedly coupled to the cylinder 300 by a plurality of coupling bolts (not shown).

Herein, the plurality of coupling bolts are coupled to coupling holes 302 of the cylinder 300 via the coupling holes 214 of the valve supporting plate 210 and the coupling holes 225 of the suction valve 220 (best seen in FIG. 5 and not shown in FIG. 10 for clarity).

The discharge holes 224 of the suction valve 220 correspond to the discharge holes 211 of the valve supporting plate 210, and the protrusions 101 of the piston 100 are positioned on the same line as the discharge holes 224 of the suction valve 220 and the discharge holes 211 of the valve supporting plate 210.

Figure 11:
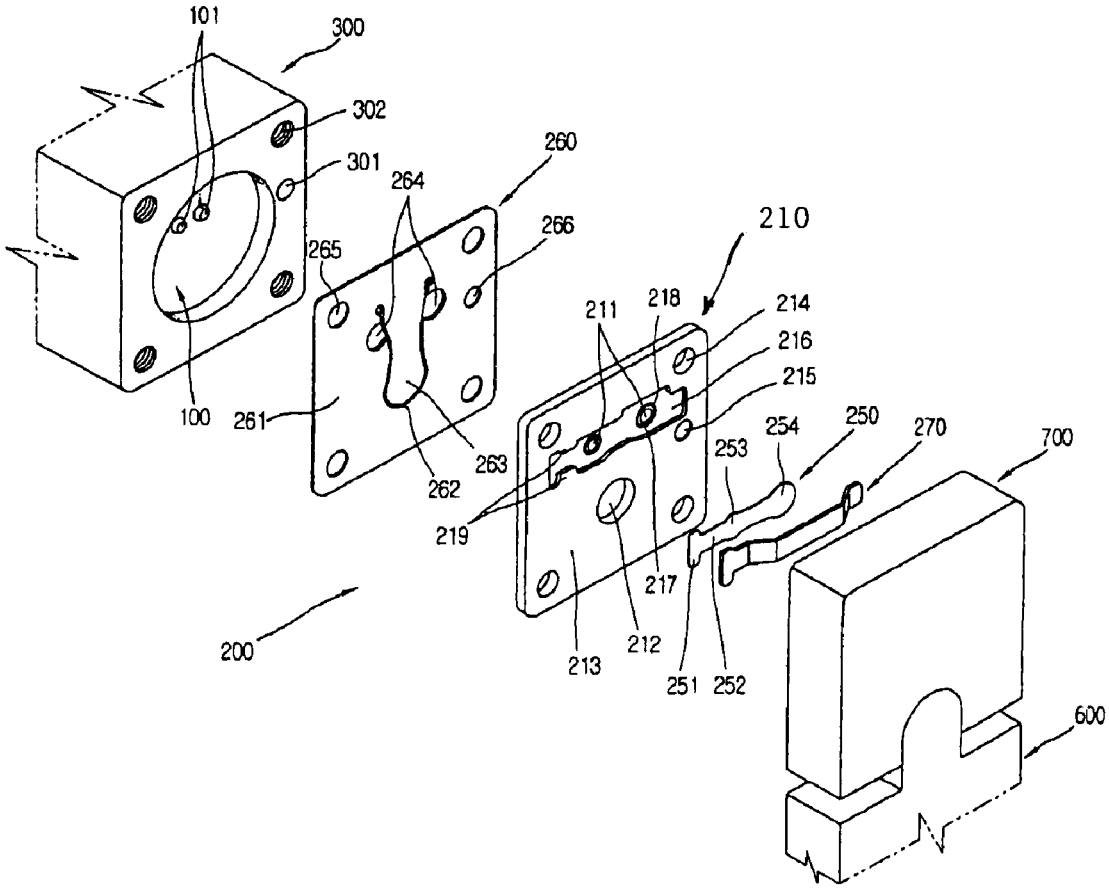
FIG. 11 is a disassembled perspective view showing the valve assembly of the compressor according to a second embodiment of the present invention.

FIG. 11 shows a valve assembly 200 according to a second embodiment of the present invention. As shown, the valve assembly comprises a valve supporting plate 210, a suction valve 260, a discharge valve 250, and a retainer 270.

The valve supporting plate 210 comprises a rectangular plate 213 having a certain thickness, discharge holes 211 formed in the plate 213 with a certain gap therebetween, one suction hole 212 penetratingly formed at the plate 213 so as to be positioned below the discharge hole 211, a plurality of coupling holes 214 formed at each corner of the plate 211, and a mounting groove 216 concaved at one surface of the plate 213 with a certain shape and depth. The surface of the plate 213 where the mounting groove 216 is formed is an opposite surface to a surface where the suction valve 260 is positioned.

Preferably, the two discharge holes 211 are formed to have different sizes from each other. Herein, a ratio (d2/d1) between an inner diameter (d1) of a relatively larger discharge hole of the two discharge holes and an inner diameter (d2) of a relatively smaller discharge hole is preferably in a range of 1.1~1.3

The two discharge holes 211 are positioned in the mounting groove 216 of the plate. Valve supporting protrusions 217 protruding from each edge of the discharge holes 211 are formed at each lower surface of the mounting groove 216 as a ring shape, and a groove 218 having a ring shape of a certain width and depth is formed at an outer periphery of the valve supporting protrusions 217. Stopping protrusions 219 for fixing the discharge valve 250 are formed at one side of the mounting groove 216. The discharge valve 250 fixed by the stopping protrusions 219 is supported by the valve supporting protrusions 217. The discharge hole 211 of the two discharge holes that is positioned near the stopping protrusions 219 has a relatively smaller size, and the discharge hole 211 positioned far from the stopping protrusions 219 has a relatively larger size.

Figure 12:
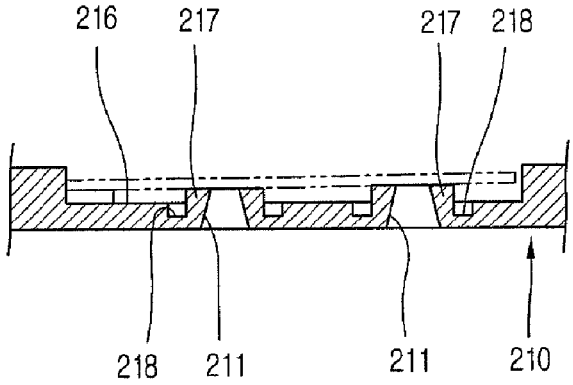
FIG. 12 is a sectional view showing a valve supporting plate of the valve assembly of the compressor according to a second embodiment of the present invention.

As shown in FIG. 12, the valve supporting protrusion 217 of the two valve supporting protrusions 217 that is positioned near the fixing portion of the discharge valve 250 has a height lower than that of another valve supporting protrusion 217.

Preferably, an inner circumferential surface of the discharge hole 211 of the valve supporting plate 210 is formed to have a conical shape. The protrusion 101 of the piston 100 and the discharge hole 211 of the valve supporting plate 210 can have the same inclination. angle or different inclination angles from each other.

Figure 13:
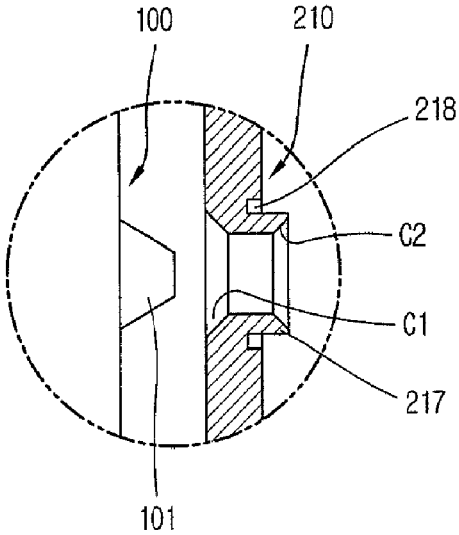
FIG. 13 is a side sectional view showing the valve supporting plate and a piston of the valve assembly of the compressor according to a second embodiment of the present invention.

As shown in FIG. 13, chamfers C1 and C2 for decreasing a flow resistance are respectively formed at both edges of an inner circumferential surface of the discharge hole 211 of the valve supporting plate.

The two discharge holes 211 of the valve supporting plate 210 are formed at positions corresponding to the two protrusions 101 formed at the pressure surface of the piston 100.

Preferably, the valve supporting plate 210 is processed after being molded by a firing operation.

Figure 14:
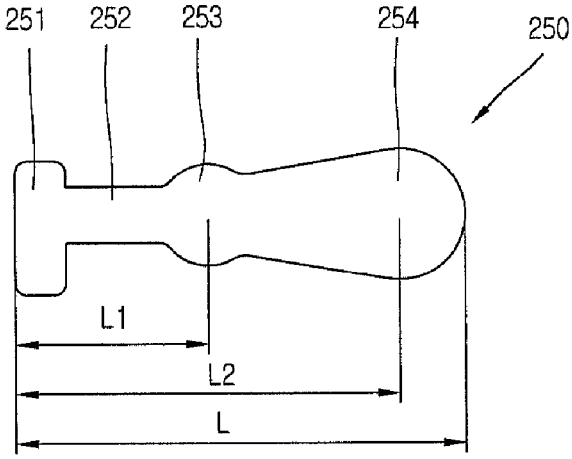
FIG. 14 is a plane view showing a discharge valve of the valve assembly of the compressor according to a second embodiment of the present invention.

As shown in FIG. 14, the discharge valve 250 comprises a fixing portion 251 having a certain shape, a connecting portion 252 extending from the fixing portion 251 with a certain length, a first open/close portion 253 extending from the connecting portion 252 as a circular shape, and a second open/close portion 254 extending from the first open/close portion 253 as a circular shape. The discharge valve 250 is a thin plate.

The fixing portion 251 of the discharge valve 250 is fixed to the stopping protrusions 219 formed at one side of the mounting groove 216 of the valve supporting plate 210. Herein, the discharge valve 250 is horizontally positioned, and the first open/close portion 253 and the second open/close portion 254 close the two discharge holes 211 formed at the valve supporting plate 210.

Preferably, a ratio (L/L1) between a length (L) of the discharge valve 250 and a distance (L1) from an end surface of the fixing portion 251 to a center of the first open/ close portion 253 is in a range of 1.8~2.5. Also, a ratio (L/L2) between the length (L) of the discharge valve 250 and a distance (L2) from the end surface of the fixing portion 251 to a center of the second open/close portion 254 is in a range of 1.1~1.3.

The suction valve 260 comprises a thin plate 261 having the same size as the valve supporting plate 210, a slit 262 formed in the thin plate 261 as a curved line, a valve portion 263 having a cantilever shape defined by the linear slit 262 for opening and closing the suction hole 212, two discharge holes 264 formed in the thin plate 261 so as to be connected to the slit 262, and a plurality of coupling holes 265 formed at each corner of the thin plate 261. The discharge holes 264 of the suction valve 260 correspond to the discharge holes 211 of the valve supporting plate 210 with different sizes from each other.

The valve portion 263, as shown in FIG. 11, of the suction valve is composed of a connection portion connected to the thin plate 261, and an open/close portion extending from the connection portion as a circular shape. A centerline of the valve portion 263 in a longitudinal direction is perpendicular to a connection line for connecting centers of the two discharge holes 264. Also, the discharge holes 264 are positioned to be symmetrical to each other on the basis of the centerline of the valve portion 263 in a longitudinal direction.

Preferably, the longitudinal direction of the valve portion 263 of the suction valve 260 is perpendicular to a longitudinal direction of the discharge valve 250 when the suction valve 260 is coupled to the valve supporting plate 210.

Connection holes 215 and 266 are formed so as to be connected to the valve supporting plate 210 and the suction valve 220, respectively. The connection holes 215 and 266 are connected to a connection hole 301 formed at the cylinder 300. The connection hole 301 is connected to a silencer SL coupled to the cylinder 300 for reducing noise.

Connection holes 215 and 226 are formed so as to be connected to the valve supporting plate 210 and the suction valve 220, respectively. The connection holes 215 and 226 are connected to a connection hole 301 formed at the cylinder 300. The connection hole 301 is connected to a silencer SL coupled to the cylinder 300 for reducing noise.

Figure 15:
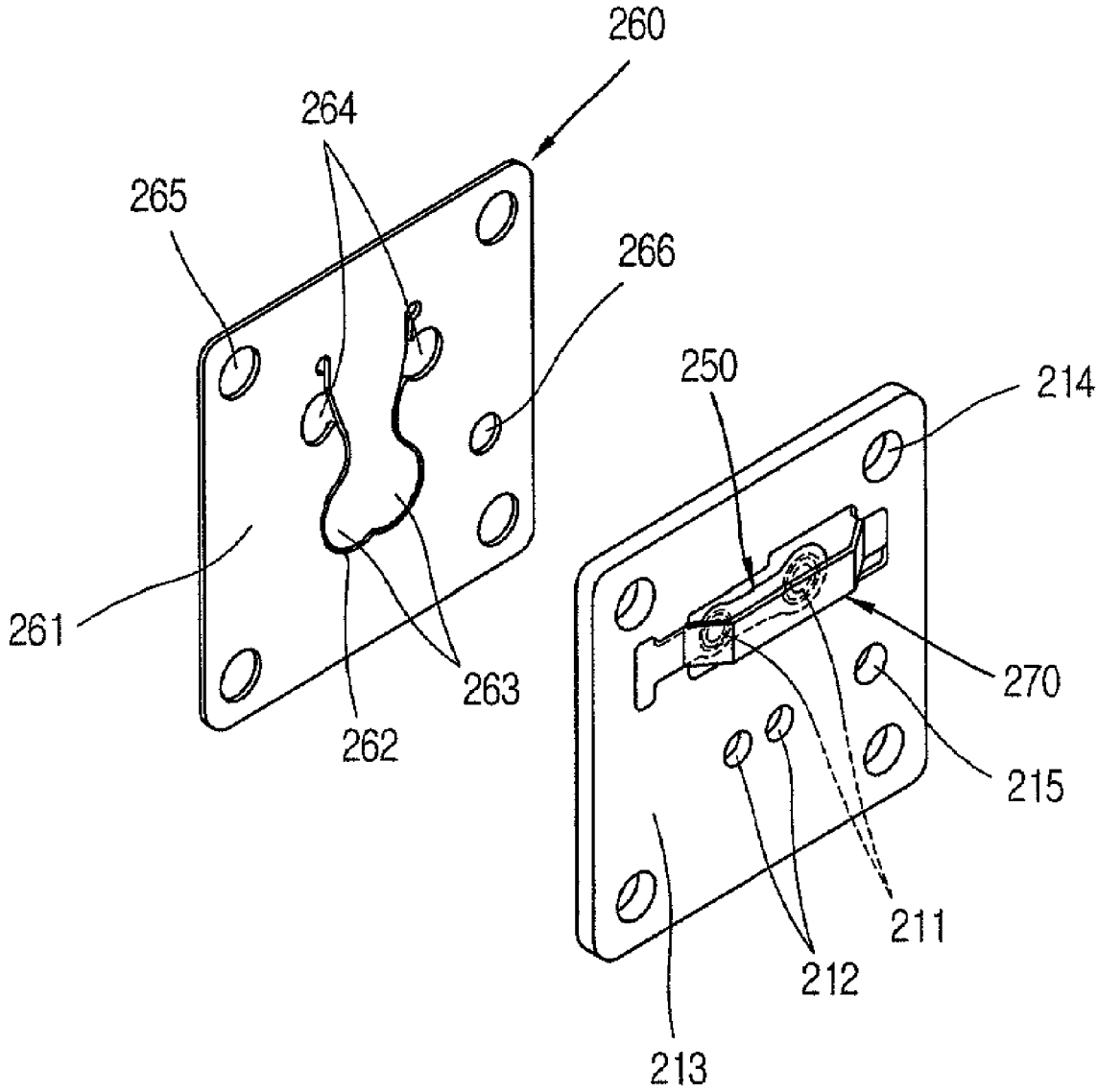
FIG. 15 is a perspective view showing a valve assembly of a compressor according to a third embodiment of the present invention.

A valve assembly according to a third embodiment of the present invention comprises a valve supporting plate 210, a discharge valve 250, and a suction valve 260 like the valve assembly according to the second embodiment. As shown in FIG. 15, the valve supporting plate 210 and the suction valve 260 of the third embodiment have the same structure as the valve supporting plate 210 and the suction valve 260 of the second embodiment. However, in this embodiment, the number of the suction holes 212 of the valve supporting plate 210 is two, and a valve portion 263 for opening and closing the two suction holes 212 has a heart shape.

In a valve assembly according to still another embodiment, a valve supporting plate having at least five holes including a suction hole for sucking gas into the cylinder and a discharge hole for discharging gas compressed in the cylinder, a suction valve, and a discharge valve can have the same shape as those of the aforementioned embodiments.

In the valve assemblies according to the second and third embodiments, a valve spring for supporting the discharge valve can be provided between the discharge valve and the retainer.

Effects of the compressor according to the present invention will be explained as follows.

When power is supplied to the compressor, the driving motor M is operated thereby to generate a rotation force. Then, the rotation force is transmitted to the crankshaft 400 to rotate the crankshaft 400. As the crankshaft 400 is rotated, the rotation force of the crankshaft 400 is transmitted to the piston 100 through the connecting rod 500, and thus the piston 100 is linearly reciprocated in the cylinder 300. As the result, gas sucked into the casing C through the gas suction pipe 4 is sucked into the cylinder 300 through the suction muffler 600 and the valve assembly 200, and then is compressed. The gas compressed in the cylinder 300 is discharged to the discharge muffler 700 through the valve assembly 200, then is introduced into the silencer SL through the connection holes 215 and 266 of the valve assembly 200 and the connection hole 301 of the cylinder, and then is discharged outside the casing C through the loop pipe 6 and the gas discharge pipe 5.

An operation of the valve assembly 200 will be explained in more detail with respect to the first exemplary embodiment.

When the piston 100 that has been inserted into the cylinder 300 is moved to a lower dead point from an upper dead point, the valve portion 223 of the suction valve is curved by a pressure difference between inside and outside of the cylinder 300 thereby to open the suction hole 212. At the same time, gas that has been introduced through the suction muffler 600 is sucked into the cylinder 300 through the suction hole 212. Herein, the two discharge valves 230 close the two discharge holes 211 of the valve supporting plate 210.

When the piston 100 is moved to the upper dead point from the lower dead point, the valve portion 223 of the suction valve is moved to the original position thereby to close the suction hole 212 and compress the gas sucked into the cylinder 300. Herein, when the gas inside the cylinder 300 has a pressure more than a preset pressure, the discharge valves 230 are curved thereby to open the discharge holes 211. The compressed gas inside the cylinder 300 is discharged through the discharge holes 211.

Since the compressed gas is discharged outside the cylinder 300 through the two discharge holes 211, the compressed gas is not concentrated into one part but is concentrated into two parts thus to be discharged outside the cylinder 300. Accordingly, a discharge flow resistance of the compressed gas is decreased.

Furthermore, since the two protrusions 101 are formed at a pressure surface of the piston 100, when the piston 100 reaches the upper dead point, the protrusions 101 of the piston 100 are positioned in the discharge holes 224 of the suction valve 220 and the discharge holes 211 of the valve supporting plate 210. Accordingly, a dead volume by the discharge holes 224 of the suction valve 220 and the discharge holes 211 of the valve supporting plate 210 is minimized. Furthermore, since the protrusions 101 of the piston 100 have a conical shape, compressed gas can be discharged to the discharge holes 224 and 211 more smoothly.

In the valve assembly according to the second embodiment, when the gas is introduced into the cylinder 300, the first open/close portion 253 and the second open/close portion 254 of the discharge valve 250 close the two discharge holes 211 of the valve supporting plate 210. At the same time, the valve portion 263 of the suction valve 260 is curved thereby to open the suction hole 212 of the valve supporting plate 210.

When gas sucked into the cylinder 300 is compressed and then is discharged outside the cylinder 300, the valve portion 263 of the suction valve 260 becomes straight thereby to close the suction hole 212 of the valve supporting plate 210. When a pressure inside the cylinder 300 is more than a preset pressure, the first open/close portion 253 and the second open/close portion 254 of the discharge valve 250 are curved thereby to open the discharge holes 211 of the valve supporting plate 210. As the result, the compressed gas is discharged through the discharge holes 211.

Since the compressed gas is discharged outside the cylinder 300 through the two discharge holes 211, the compressed gas is not concentrated into one part but is concentrated into two parts thereby to decrease a discharge flow resistance. Furthermore, since the discharge hole 211 positioned near the fixing portion 251 of the discharge valve 250 is formed to have a relatively smaller size and the discharge hole 211 positioned far from the fixing portion 251 is formed to have a relatively larger size, when the first open/close portion 253 and the second open/close portion 254 of the discharge valve 250 are curved to open the discharge holes 211, a discharge flow resistance of the compressed gas through the two discharge holes 211 is decreased. This occurs as a result of the amount of compressed gas passing through the respective discharge holes 211 so that the second open/close portion 254 is lifted further away from the valve supporting plate 210 than the first open/close portion 253. The difference in heights of the stopping protrusions 219 also contribute to this effect.

Also, since the two protrusions 101 are formed at the pressure surface CS of the piston 100, when the piston 100 reaches the upper dead point, the protrusions 101 of the piston 100 are positioned in the discharge holes 264 of the suction valve 260 and the discharge holes 211 of the valve supporting plate 210. Accordingly, a dead volume by the discharge holes 264 of the suction valve 260 and the discharge holes 211 of the valve supporting plate 210 is minimized.

In the valve assembly according to the third embodiment, since gas is sucked into the cylinder 300 through the two suction holes 212, the gas is not concentrated to one part but is concentrated to two parts thereby to decrease a suction flow resistance of the gas. Also, since the compressed gas inside the cylinder 300 is discharged outside the cylinder 300 through the two discharge holes 211, the compressed gas is not concentrated into one part but is concentrated into two parts thus to be discharged outside the cylinder 300. Accordingly, a discharge flow resistance of the compressed gas is decreased. Furthermore, since the two protrusions 101 are formed at the pressure surface CS of the piston 100, a dead volume by the discharge hole 264 of the suction valve 260 and the discharge hole 211 of the valve supporting plate 210 is minimized.

As aforementioned, in the compressor of the present invention, when gas is sucked into the cylinder, a suction flow resistance of the gas is decreased thereby to enhance a gas suction efficiency. Furthermore, when compressed gas inside the cylinder is discharged outside the cylinder, a discharge flow resistance of the gas is decreased to thereby reduce a pressure loss. Furthermore, since a dead volume is minimized, a gas suction efficiency is increased and thereby an entire compression efficiency of the compressor is enhanced. The compressor, and especially the valve assembly therein, may be used not only in the compression of refrigerants, but instead may be used with any compressible medium or gas, such as air, nitrogen, etc. Also, the compressor may be configured to be driven not only by an internal electric motor in a hermetically sealed casing, but may instead be externally driven by an external drive source, such as an electric or gasoline powered motor, and may be direct drive, belt drive, or other alternative drive arrangements.

The invention claimed is:

1. A compressor comprising:

a casing to which a gas suction pipe is connected;

a driving motor provided in the casing;

a cylinder;

a valve supporting plate covering the cylinder, the valve supporting plate having a suction hole for sucking gas into the cylinder and two discharge holes for discharging gas compressed in the cylinder;

a piston having two protrusions at a pressure surface in correspondence to the two discharge holes of the valve supporting plate, the two protrusions having different sized cross-sections, the piston being linearly reciprocal in the cylinder by receiving a driving force of the driving motor;

a suction valve coupled to the valve supporting plate to open and close the suction hole; and a discharge valve assembly coupled to the valve supporting plate to open and close the two discharge holes, wherein the discharge valve assembly includes a single discharge valve to open and close the two discharge holes, wherein valve supporting protrusions extend from each edge of the discharge holes for supporting the discharge valve, a valve supporting protrusion of the two valve supporting protrusions that is positioned nearest a fixing portion fixed to one side of the valve supporting plate for fixing the discharge valve to the valve supporting plate has a height lower than that of the other valve supporting protrusion, and wherein a relatively smaller one of the two discharge holes is located between the fixing portion and a relatively larger one of the two discharge holes.

2. The compressor of claim 1, wherein a ratio (d2/d1) between an inner diameter (d1) of the relatively larger discharge hole of the two discharge holes and an inner diameter (d2) of the relatively smaller discharge hole is in a range of 1.1 to 1.3.

3. The compressor of claim 1, wherein the two protrusions formed at the pressure surface of the piston are formed at positions having different distances from a centerline of the pressure surface.

4. The compressor of claim 1, wherein the protrusions of the piston have a truncated conical shape.

5. The compressor of claim 4, wherein for each protrusion of the piston, a ratio (D2/D1) between a maximum outer diameter D1 positioned at the pressure surface and a minimum outer diameter D2 of an end surface of each protrusion of the piston is in a range of 1.5 to 2.5.

6. The compressor of claim 1, wherein an inner circumferential surface of each of the discharge holes of the valve supporting plate has a conical shape.

7. The compressor of claim 1, wherein a chamfer for decreasing a flow resistance is formed at an edge of a gas inlet of an inner circumferential surface of each of the discharge holes.

8. The compressor of claim 1, wherein a chamfer for decreasing a flow resistance is formed at an edge of a gas outlet of an inner circumferential surface of each of the discharge holes.

9. The compressor of claim 1, wherein a ring-shaped groove is formed at an outer periphery of each of the valve supporting protrusions.

10. The compressor of claim 1, wherein the discharge valve comprises:

a connecting portion extending from the fixing portion;

a first open/close portion extending from the connecting portion as a circular shape; and a second open/close portion extending from the first open/close portion as a circular shape.

11. The compressor of claim 10, wherein a ratio (L/L1) between a length (L) of the discharge valve and a distance (L/1) from an end surface of the fixing portion to a center of the first open/close portion is in a range of 1.8 to 2.5, and a ratio (L/L2) between the length (L) of the discharge valve and a distance (L2) from the end surface of the fixing portion to a center of the second open/close portion is in a range of 1.1 to 1.3.

12. The compressor of claim 1, wherein the suction valve comprises:

a thin plate;

a valve portion for opening and closing the suction hole, the valve portion having a cantilever shape defined by a linear slit formed at the thin plate; and two discharging holes respectively connected to the slit.

13. The compressor of claim 12, wherein the valve portion of the suction valve is mounted at the valve supporting plate so that a longitudinal direction of the valve portion can cross a longitudinal direction of the discharge valve.

14. The compressor of claim 12, wherein a centerline of the valve portion in a longitudinal direction crosses a connection line for connecting centers of the two discharge holes of the valve supporting plate.

15. The compressor of claim 1, wherein connection holes are formed in the cylinder, the suction valve, and the valve supporting plate, the connection holes being in communication with a silencer coupled to the cylinder for reducing noise.

16. A cylinder assembly comprising:

a cylinder;

a valve supporting plate covering the cylinder, the valve supporting plate having a suction hole for sucking gas into the cylinder and two discharge holes for discharging gas compressed in the cylinder;

a piston having two protrusions at a pressure surface in correspondence to the two discharge holes of the valve supporting plate, the two protrusions having different sized cross-sections;

a suction valve coupled to the valve supporting plate to open and close the suction hole; and a discharge valve assembly coupled to the valve supporting plate to open and close the two discharge holes, wherein the discharge valve assembly includes a single discharge valve to open and close the two discharge holes wherein valve supporting protrusions extend from each edge of the discharge holes for supporting the discharge valve, a valve supporting protrusion of the two valve supporting protrusions that is positioned nearest a fixing portion fixed to one side of the valve supporting plate for fixing the discharge valve to the valve supporting plate has a height lower than that of the other valve supporting protrusion, and wherein a relatively smaller one of the two discharge holes is located between the fixing portion and a relatively larger one of the two discharge holes.

17. The cylinder assembly of claim 16, wherein the relatively smaller one of the two discharge holes is located along a straight line extending between the fixing portion and the relatively larger one of the two discharge holes.

18. A valve assembly comprising:

a valve supporting plate having a suction hole for sucking gas and two discharge holes for discharging compressed gas, wherein the two discharge holes have different sized cross-sections;

a suction valve coupled to the valve supporting plate to open and close the suction hole; and a single discharge valve coupled to the valve supporting plate to open and close the two discharge holes, wherein valve supporting protrusions extend from each edge of the discharge holes for supporting the discharge valve, a valve supporting protrusion of the two valve supporting protrusions that is positioned nearest a fixingportion fixed to one side of the valve supporting plate for fixing the discharge valve to the valve supporting plate has a height lower than that of the other valve supporting protrusion, and wherein a relatively smaller one of the two discharge holes is located between the fixing portion and a relatively larger one of the two discharge holes.

* * * * *